US005690665A

United States Patent [19]

Mann

[11] Patent Number: 5,690,665

[45] Date of Patent: Nov. 25, 1997

[54] ROTATABLE EAR PIERCING CARTRIDGE ASSEMBLY

[75] Inventor: Samuel J. Mann, Englewood, N.J.

[73] Assignee: Inverness Corporation, Fair Lawn, N.J.

[21] Appl. No.: 600,427

[22] Filed: Feb. 13, 1996

[51] Int. Cl.[6] ..... A61B 17/34

[52] U.S. Cl. ..... 606/188

[58] Field of Search ..... 606/188, 167, 606/185, 117

[56] References Cited

U.S. PATENT DOCUMENTS

| | | | |
|---|---|---|---|
| 4,527,563 | 7/1985 | Reil | 606/188 |
| 4,860,747 | 8/1989 | Sciara | 606/188 |
| 5,004,470 | 4/1991 | Mann | 606/188 |
| 5,004,471 | 4/1991 | Mann | 606/188 |
| 5,007,918 | 4/1991 | Mann | 606/188 |
| 5,263,960 | 11/1993 | Mann | 606/188 |
| 5,350,394 | 9/1994 | Mann | 606/188 |
| 5,360,434 | 11/1994 | Mann | 606/188 |

FOREIGN PATENT DOCUMENTS

| | | | |
|---|---|---|---|
| 2142538 | 1/1985 | United Kingdom | 606/188 |

*Primary Examiner*—Michael Buiz
*Assistant Examiner*—Patrick W. Rasche
*Attorney, Agent, or Firm*—Stroock & Stroock & Lavan LLP

[57] ABSTRACT

An ear piercing gun including a housing, a push rod and a stud cartridge receiving chamber for receiving a stud cartridge therein. The stud cartridge can rotate in a clockwise and/or counterclockwise direction so that a stud releasably secured within the stud cartridge can be coaxially aligned with the push rod to accurately pierce an ear. The gun may also include a clutch positioner adapted to receive a clutch cartridge. The clutch cartridge can rotate in a clockwise and/or counterclockwise direction so that a clutch releasably secured in the clutch cartridge can be coaxially aligned with the push rod. The stud, the clutch and the push rod may be simultaneously coaxially aligned with each other to accurately pierce an ear.

40 Claims, 7 Drawing Sheets

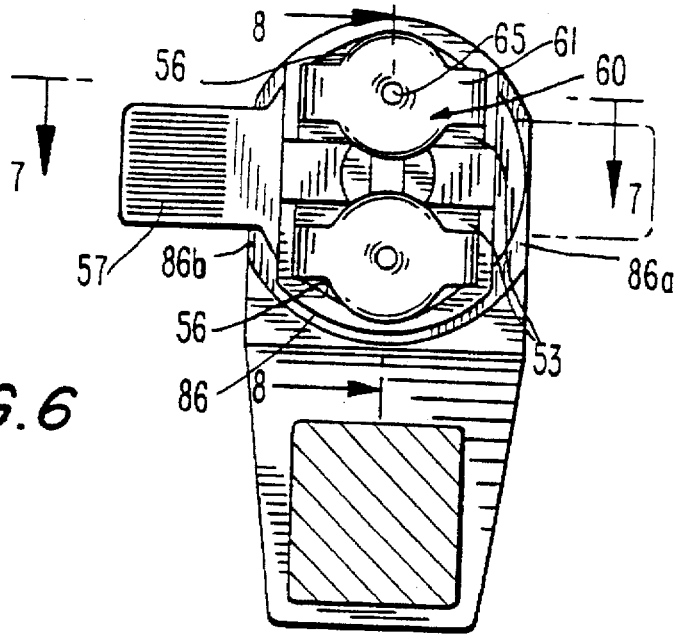
FIG. 6
FIG. 7
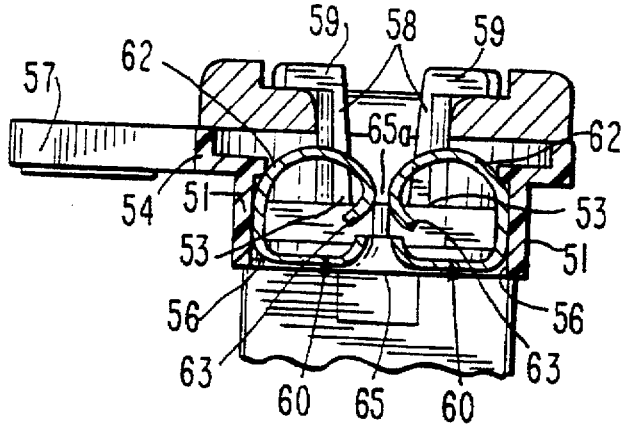
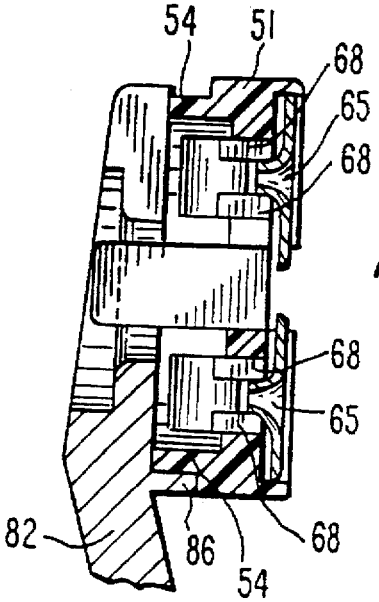
FIG. 8

FIG. 9
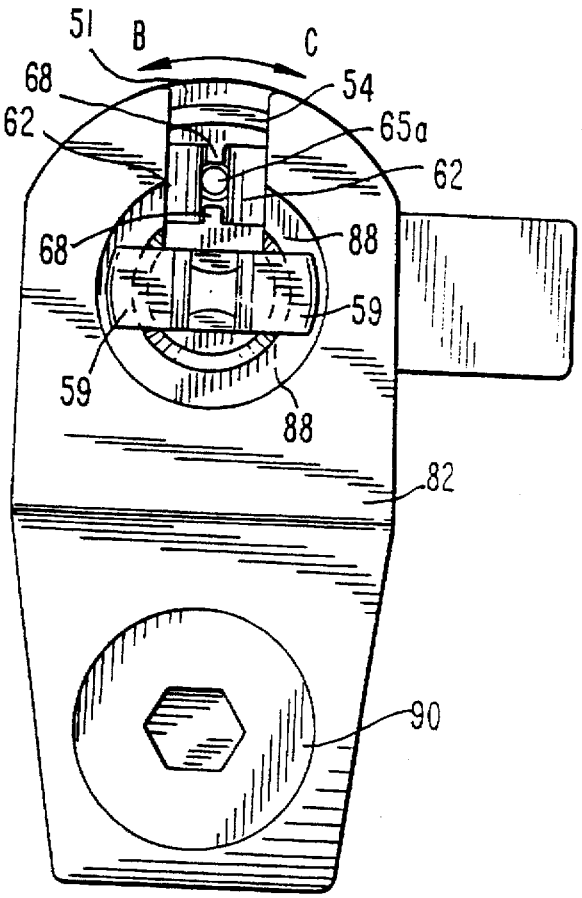
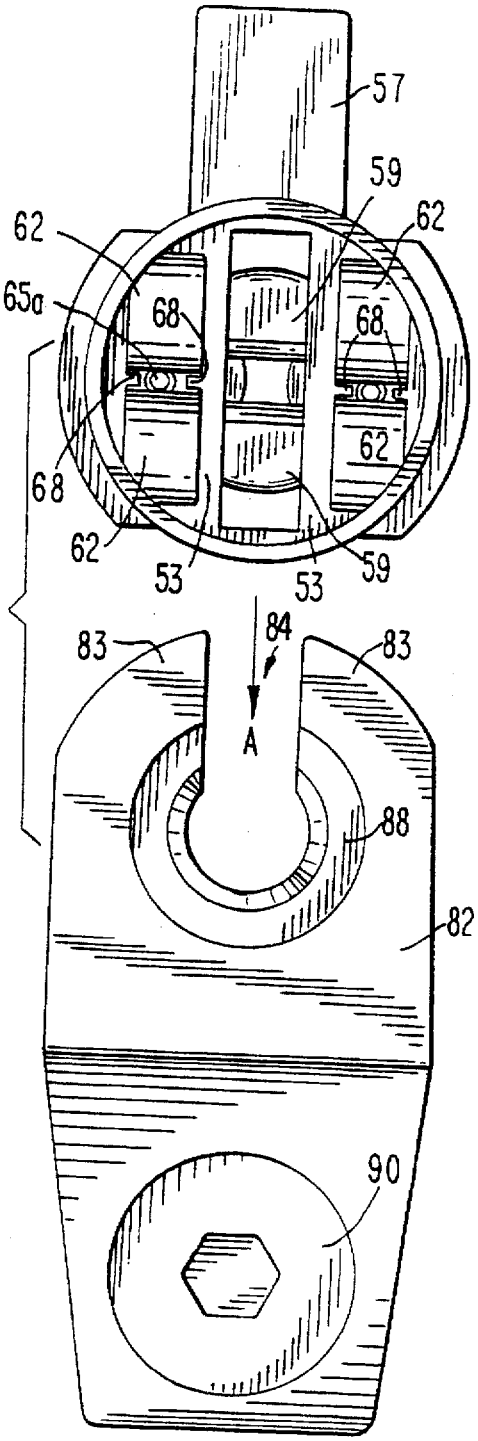
FIG. 10

95
D
80
94
92
97
67
75
98
72
99
99
103
102
93
103a
92a
123
104
104a
104b
38
82
77
H
F
E
117
126
118
120
123
106
128
130a
128
130b
116a
116
130
114b
114
114a
110
126

ROTATABLE EAR PIERCING CARTRIDGE ASSEMBLY

BACKGROUND OF THE INVENTION

The present invention relates in general to an ear piercing cartridge assembly and, in particular, to an ear piercing cartridge assembly which includes an ear piercing assembly adapted to receive a rotatable stud cartridge and rotatable clutch cartridge.

Ear piercing systems using ear piercing guns are well known in the prior art. Present ear piercing systems are particularly characterized by a stud with a sharpened point being inserted through an earlobe by the action of a spring loaded instrument. A state of the art ear piercing cartridge assembly is exemplified in U.S. Pat. No. 5,004,470 owned by Inverness Corporation.

The system described in U.S. Pat. No. 5,004,470 includes a stud and clutch cartridge each of which can respectively hold up to two studs and two clutches. Once the stud and clutch cartridges are mounted onto the ear piercing assembly, the stud, clutch and push rod (which forces the stud through the ear) are coaxially aligned by the slidable displacement of the clutch and stud cartridges relative to the ear piercing assembly. This system is directed at preventing the transmission of infectious diseases. In particular, the reduction in the need to handle each individual clutch and stud by the instrument user has increased the integrity of the sterility of the piercing procedure.

However, the aforementioned system uses stud cartridges and clutch cartridges that are merely slidably displaceable into a piercing position.

Accordingly, an ear piercing cartridge assembly that maintains a high level of sterility during the ear piercing operation and further reduces the likelihood of human contact by the instrument user with the stud and the clutch during a piercing procedure is desired.

SUMMARY OF THE INVENTION

Generally speaking, in accordance with the present invention, an improved ear piercing assembly is provided. The ear piercing assembly includes a housing, a push rod and a stud cartridge receiving chamber for receiving a stud cartridge therein. The stud cartridge receiving chamber is adapted to permit the stud cartridge to rotate within the chamber so that when the stud cartridge is rotated between a first position and a second position, a stud releasably secured within the cartridge can be coaxially aligned with the push rod to accurately pierce an ear. The assembly also includes a clutch cartridge receiving assembly adapted to receive a clutch cartridge. The clutch cartridge receiving assembly is constructed to permit the clutch cartridge to rotate therein so that when the clutch cartridge is rotated between a first position and a second position, a first clutch releasably secured in the clutch cartridge can be coaxially aligned with the push rod. Furthermore, the stud and the clutch may be simultaneously coaxially aligned with each other to achieve a desired ear piercing result. In a preferred embodiment, the stud cartridge receiving chamber is formed integrally with the housing and is defined by walls adapted to receive the stud cartridge when the stud cartridge is aligned in a first position. The walls are further formed to secure the stud cartridge within the stud cartridge receiving chamber when the push rod and a stud are coaxially aligned. The clutch cartridge receiving assembly may also be constructed to receive the clutch cartridge when the clutch cartridge is aligned in a first position and secure the clutch cartridge within the clutch cartridge receiving assembly when the push rod and the clutch are coaxially aligned.

Accordingly, it is an object of the present invention to provide an improved ear piercing cartridge assembly.

A further object of the invention is to provide an ear piercing assembly which minimizes handling of the stud and clutch cartridges during an ear piercing procedure.

Yet another object of the present invention is to provide an ear piercing assembly that maintains the sterile integrity of the stud and clutch prior to and during the ear piercing procedure.

Another object of the present invention is to provide an ear piercing assembly in which the stud and clutch are easily and accurately aligned prior to the piercing of the earlobe.

A further object of the present invention is to provide an ear piercing assembly in which the clutch cartridge and stud cartridge may be disposable.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is made to the following description taken in connection with the accompanying drawings in which:

FIG. 6 is a sectional view taken along line 6—6 of FIG. 2;

FIG. 7 is a sectional view taken along line 7—7 of FIG. 6;

FIG. 8 is a sectional view taken along line 8—8 of FIG. 6;

FIG. 9 is a sectional view taken along line 9—9 of FIG. 3;

FIG. 10 is a front elevational view of a clutch positioner and clutch cartridge constructed in accordance with the present invention;

DETAILED DESCRIPTION OF THE PREFERRED EMBODIMENTS

Figure 1:
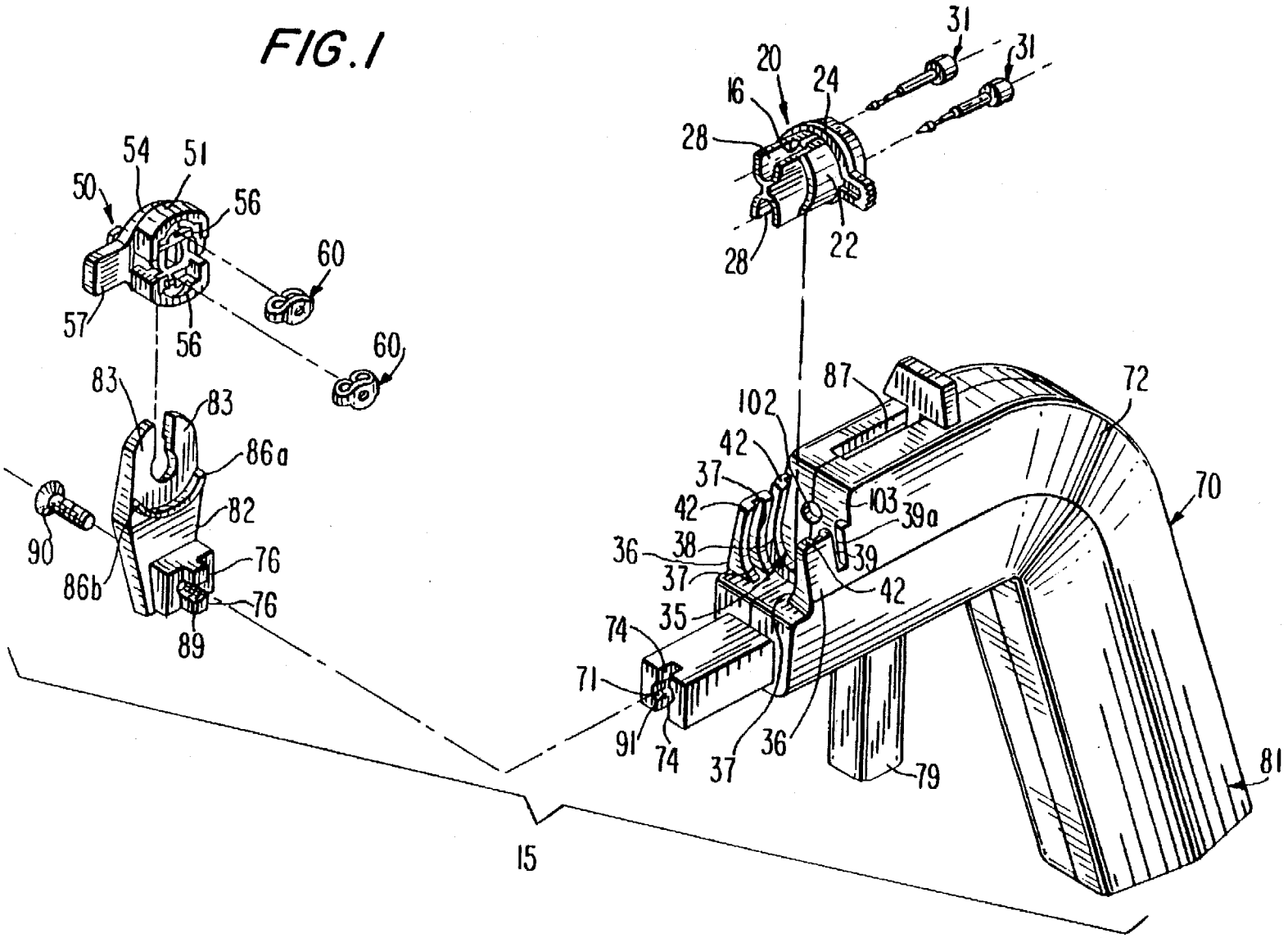
FIG. 1 is an exploded perspective view of an ear piercing assembly constructed in accordance with the present invention.

Reference is first made to FIG. 1 wherein an ear piercing cartridge assembly ("ear piercing assembly"), constructed in accordance with the present invention, and generally indicated at 15, is depicted. Ear piercing assembly 15 includes a stud cartridge, generally indicated at 20, a clutch cartridge, generally indicated at 50, and a spring gun assembly, generally indicated at 70.

Figure 11:
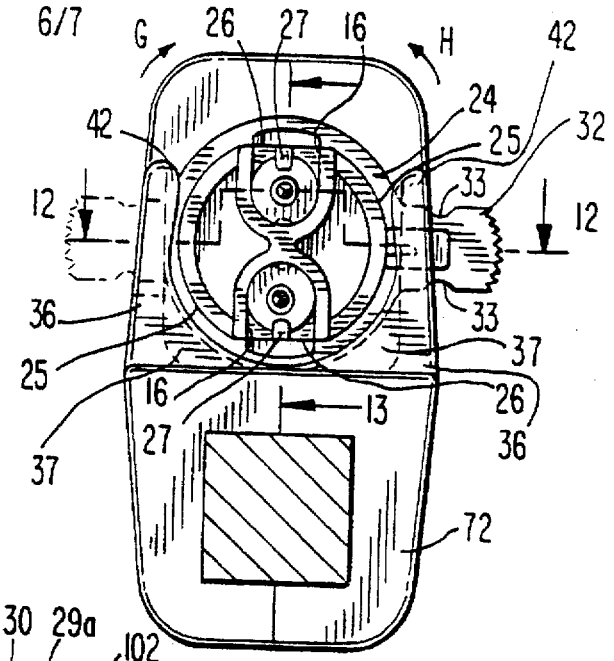
FIG. 11 is a sectional view taken along line 11—11 of FIG. 2.
Figure 12:
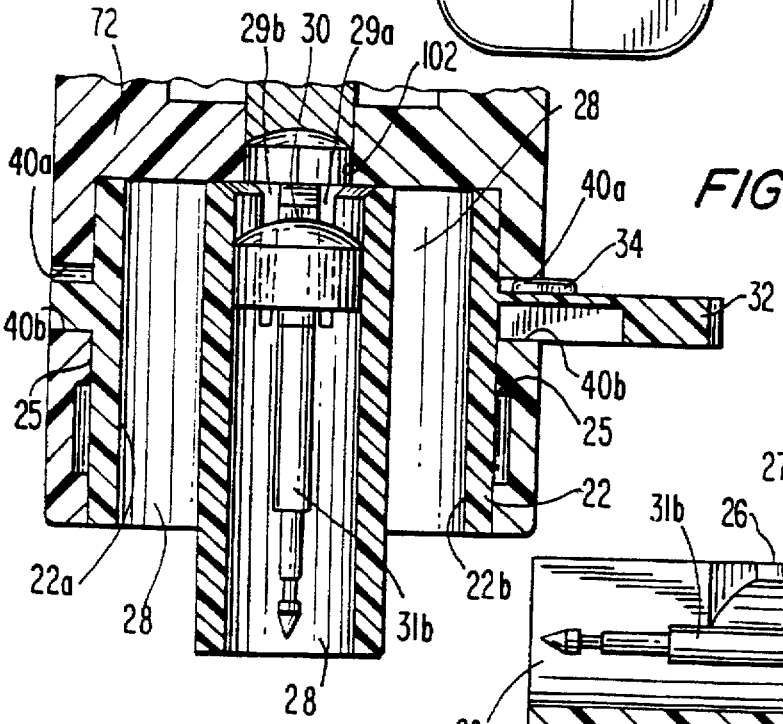
FIG. 12 is a sectional view taken along line 12—12 of FIG. 11.
Figure 13:
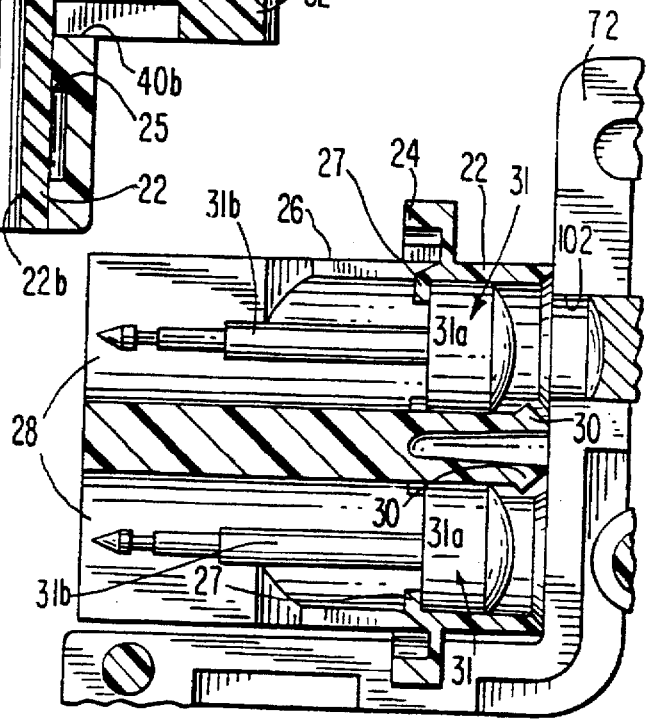
FIG. 13 is a sectional view taken along line 13—13 of FIG. 11.

Reference is now made to FIGS. 11–13 which illustrate stud cartridge 20 in greater detail. Stud cartridge 20 includes a casing 22 and an annular shoulder 24 integral with and extending around the surface of casing 22. A portion of casing 22 includes opposed flat sliding surfaces 26 formed tangential to and parallel with each other on the outer surface of casing 22. A portion of casing 22 includes curved rotating surfaces 25 integrally formed with sliding surfaces 26 to form the outer surface of casing 22.

A finger lever 32 extends integrally from annular shoulder 24 and parallel to opposed flat sliding surfaces 26. As discussed in greater detail below, finger lever 32 facilitates the mounting of stud cartridge 20 in spring gun assembly 70 and the rotation thereof during the ear piercing procedure. A molded rib 34 extends from a front surface of finger lever 32 to permit stud cartridge 20 to lock in place during the ear piercing procedure. Similarly, notches 33 molded in finger lever 32 permit stud cartridge 20 to be placed in a locked position during the ear piercing procedure, as described below.

Figure 2:
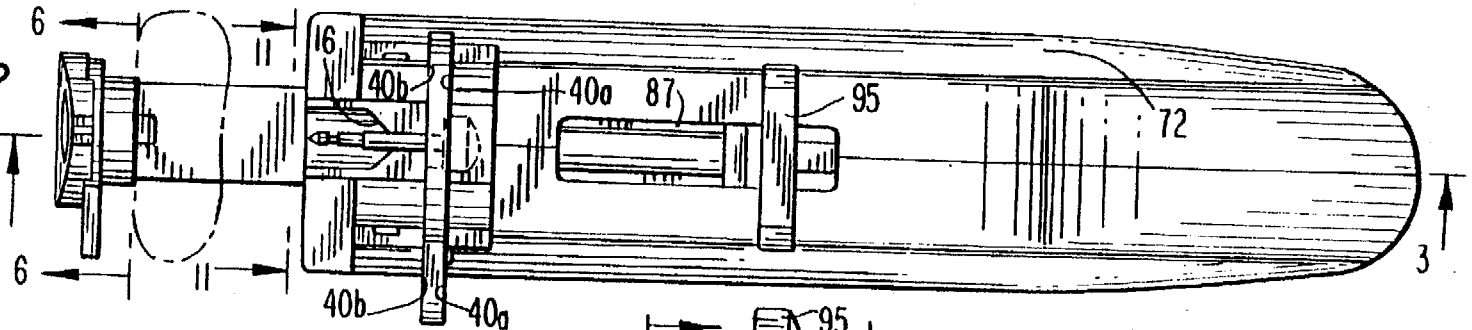
FIG. 2 is a top plan view of the ear piercing assembly depicted in FIG. 1.

Inner walls **22*a*, 22*b* of casing 22 extending from shoulder 24 past curved surfaces 25 define two parallel bores 28 within casing 22 which axially extend through the length of casing 22. Each bore 28 receives a stud, generally indicated at 31, having a head 31 a and an integrally formed piercing pin 31*b*. The diameter of each bore 28 is dimensioned with respect to the size of each stud 31 to lightly retain the studs therein by an interference fit. To further secure each stud 31 within each bore 28, opposed slots 29*a* and 29*b* are formed in each respective bore 28 so as to form a finger 30 therein. Each finger 30 is biased against a respective head 31*a* to retain each respective stud 31 by biasing the top surface thereof within each bore 28 until the stud is fired from stud cartridge 20 during the ear piercing procedure. Also molded integrally with casing 22 in each bore 28 is a tab 27 to assist in retaining each stud 31 (from the bottom surface of head 31*a*) within each respective bore 28 prior to the firing of stud 31 within an ear. Tab 27 is within the piercing path of stud 31 so that upon firing of each respective stud 31, each respective tab 27 is sheared from casing 22 and harmlessly falls from bore 28 so as not to interfere with the ear piercing procedure. Inner walls 22*a*, 22*b* do not entirely envelop stud 31. Each bore 28 is formed with a groove 16 (FIG. 2) aligned at the top of stud cartridge 20 when stud 31** is to be fired thereby providing an aiming groove.

Reference is now made to FIGS. 6–10 wherein clutch cartridge 50, including a clutch housing 51 and clutches 60, is depicted. Clutch housing 51 includes an annular back band 54 and two opposed clutch compartments 56 projecting from and integral with back band 54. Extending integrally with back band 54 is a clutch cartridge handle 57. Clutch cartridge handle 57 facilitates the handling of clutch cartridge 50 as well as facilitates rotation of clutch cartridge 50 as discussed below because of the ease with which one can grasp clutch cartridge 50 by handle 57. A pair of biased legs 58, integrally molded with cartridge inner walls 53, are aligned in parallel relation to handle 57 and facilitate the securing of clutch cartridge 50 to a clutch positioner 82 during the ear piercing procedure, as further discussed below. Each leg 58 includes an orthogonally depending entrapment foot 59 integrally molded therewith.

Each clutch 60 is formed of a single piece of resilient metal having a substantially flat backing plate 61 and integrally formed C-shaped symmetrical loops 62, each loop having an end 63. Plate 61 is shaped to be received against the back surface of an earlobe. An opening 65 is provided in each respective plate 61 and dimensioned to receive piercing pin **31*b* of stud 31. Each clutch compartment 56 is formed by back band 54 on one side, ribs 68 at the rear, and inner walls 53 at a second side opposed to back band 54 and integrally formed therewith. Ribs 68 are integrally formed in each clutch compartment 56 and assist in the positioning of clutches 60 in clutch chamber 64. Ribs 68 are disposed between each end 63 of each loop 62 of each clutch 60 to ensure that an opening 65*a*, between ends 63 of each loop 62, and coaxial with opening 65, is provided for receiving piercing pin 31*b* therebetween. Each compartment 56 is of sufficient depth to permit each backing plate 61 of each clutch 60 to be recessed from the outer surface of each clutch compartment 56 so that the likelihood of clutch 60 contacting a person's finger when clutch cartridge 50 is inserted into spring gun assembly 70 is reduced. Each clutch compartment 56 is configured to releasably secure each clutch 60 therein until each clutch 60 is secured on piercing pin 31*b* of stud 31 during the ear piercing procedure. When piercing pin 31*b* enters opening 65 and continues until it is between each end 63 of each loop 62, ends 63 are spread apart and will no longer be held by the biasing of ribs 68 against loops 62. In this way, each clutch 60 is releasably secured within each compartment 56**.

Reference is now made to FIGS. 1, 2, 3 and 14 wherein spring gun assembly 70 is depicted in detail. Spring gun assembly 70 includes a housing 72, a plunger 77, a push rod assembly 80 and a clutch positioner 82. Plunger 77 includes a depending trigger 79 for providing a finger grip. At the handle end of housing 72 extends a handle assembly, generally indicated as 81. Clutch positioner, or anvil 82, is provided at an end of plunger 77 opposed and at a distance from push rod assembly 80.

Anvil 82 includes two spaced apart walls 83 defining a slot 84 (FIG. 10) therebetween and dimensioned to receive legs 58 of clutch cartridge 50 when clutch cartridge 50 is oriented so that legs 58 are aligned parallel to slot 84 as depicted in FIG. 10. In this way, clutch cartridge 50 may be slid in the direction of arrow A (FIG. 10) into position in anvil 82 for positioning during an ear piercing procedure. On the front surface of anvil 82 is an integral shoulder 86 having edges **86*a* and 86*b*. Shoulder 86 receives thereagainst annular back band 54 of clutch housing 51. A recessed annular track 88 is provided on the back surface of anvil 82 (FIGS. 9, 10). Track 88 is dimensioned to receive foot 59 of each leg 58 and permits rotation of clutch cartridge 50 along track 88 in the direction of arrows B and C (FIG. 9) to achieve the two opposed clutch cartridge positions depicted in FIG. 6**.

In the preferred embodiment, anvil 82 includes an aperture 89 dimensioned to receive a screw 90 or the like. Correspondingly, plunger 77 has an opening 91 to receive screw 90. In this way, anvil 82 may be mounted on plunger 77. Pegs 76 are integrally formed on the front surface of anvil 82 and are respectively received by a slot 71 defined by inner walls 74 in plunger 77. In this way, anvil 82 will not rotate about plunger 77 when anvil 82 is mounted and secured thereto by screw 90. Alternatively, anvil 82 may be formed integrally with plunger 77.

Figure 3:
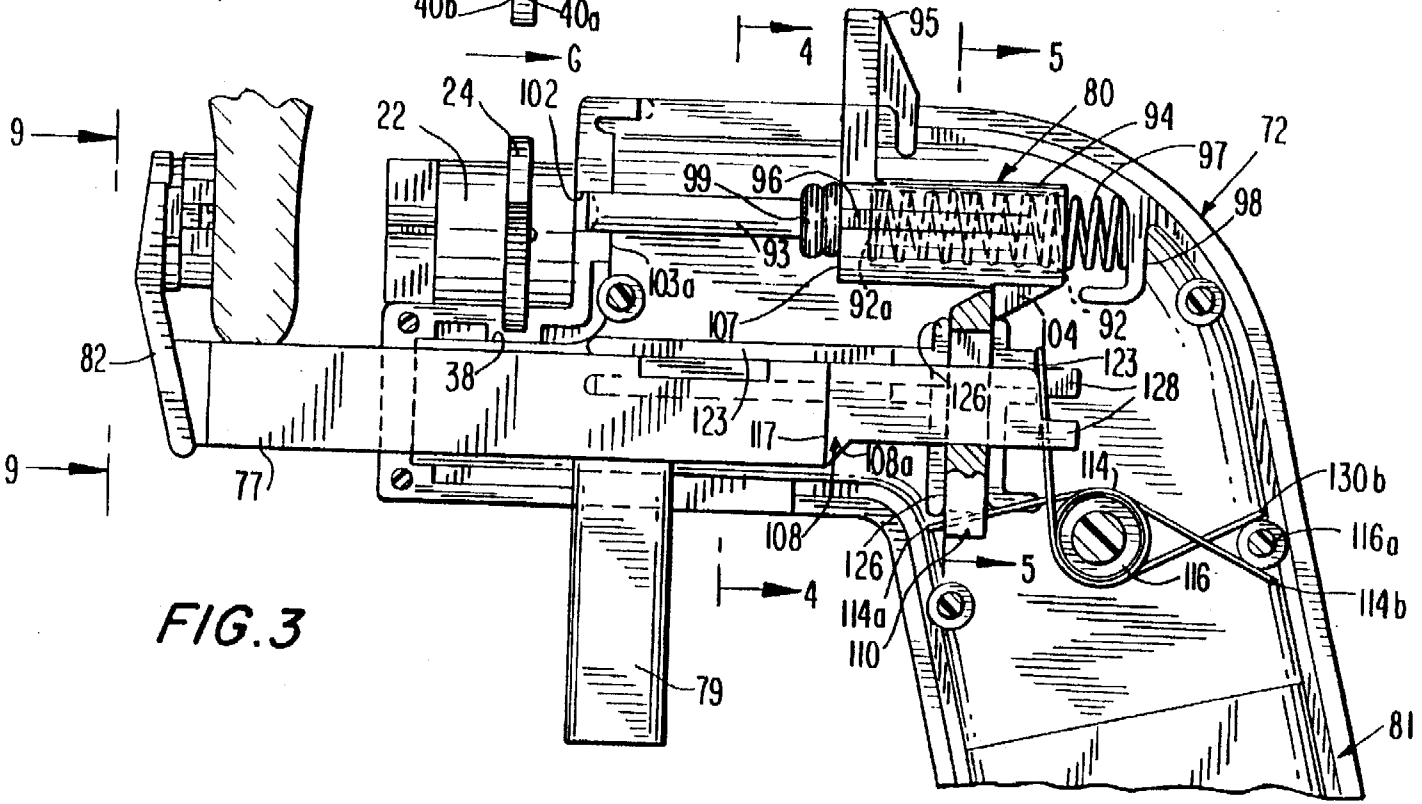
FIG. 3 is a sectional view taken along line 3—3 of FIG. 2 showing the invention prior to an ear piercing procedure.
Figure 14:
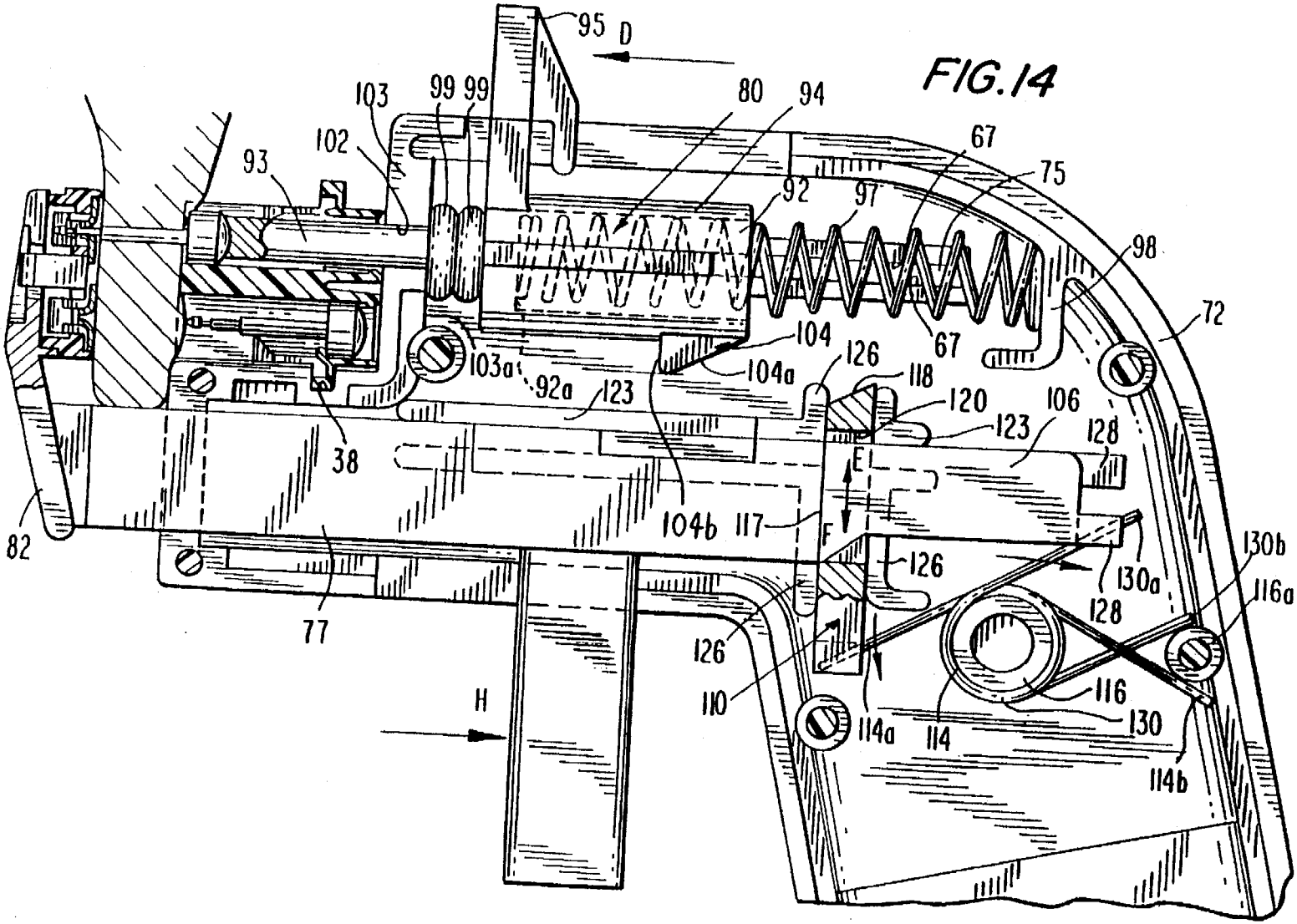
FIG. 14 is a sectional view of the ear piercing assembly showing the stud and clutch after an ear piercing procedure.

Reference is now made to FIGS. 3 and 14 which depict in detail push rod assembly 80. Push rod assembly 80 includes a push rod 93, and a preferably integrally formed spring chamber 94 and a cocking lever 95, also preferably integrally coupled to push rod 93 and spring chamber 94. Push rod assembly 80 may also include a rib 96 integrally formed on opposing sides of spring chamber 94 and slidably contained within a groove 75 (FIGS. 4 and 5) formed on each inner surface of housing 72 and defined by respective inner walls 67 to permit push rod assembly 80 to be slidably displaced within housing 72 between a firing ready position (FIG. 3) and a piercing position (FIG. 14). An elongated bore 92 having an inner back wall 92*a* is formed within spring chamber 94 of push rod assembly 80 and dimensioned to receive biasing means such as a spring 97 therein. One end of spring 97 is biased against inner back wall 92*a* of spring chamber 94. Spring 97 biases push rod 93 in the direction of anvil 82 as shown by arrow D in FIG. 14. A stop wall 98 may be integrally molded within housing 72 and receives thereagainst the end of spring 97 extending out from spring chamber 94, so that spring 97 is anchored between stop wall 98 and inner back wall 92*a*. A triangular ramp 104, integral with the bottom surface of spring chamber 94, includes a sloped surface 104*a* and a side surface 104*b*. The function of ramp 104 is described below.

An elongated aperture or slot 87 (FIG. 2) is formed in housing 72. Cocking lever 95 extends through slot 87. Slot 87 is of a sufficient length to permit cocking lever 95 and push rod assembly 80 to be slidably displaced between a firing ready position (FIG. 3) and an ear piercing position (FIG. 14).

An aperture 102 is formed in a front wall 103 of housing 72 and dimensioned to permit push rod 93 to slide therethrough. Push rod 93 may have thereon one or more resilient cushions 99, preferably made of rubber, to be provided and disposed over push rod 93 and against a front surface 107 of spring chamber 94. In this way, when push rod assembly 80 moves forward in the direction indicated by arrow D (FIG. 14) during the piercing procedure, cushions 99 can contact an inner surface 103*a* of wall 103 of housing 72, and absorb the force of the contact between push rod assembly 80 and housing 72, thereby preventing damage to both push rod assembly 80 and housing 72 and providing quiet operation.

Figure 4:
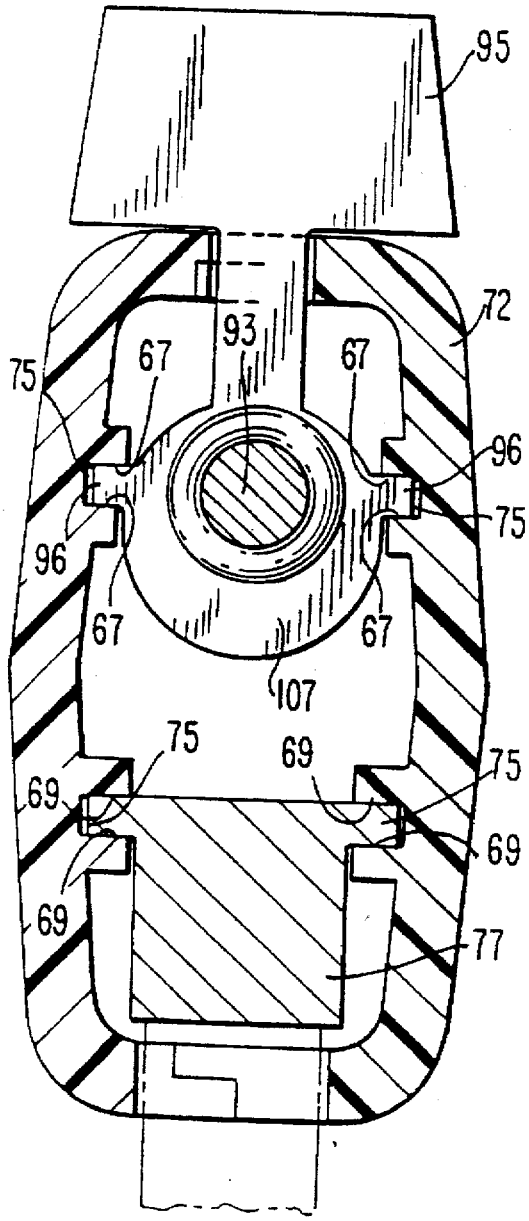
FIG. 4 is a sectional view taken along line 4—4 of FIG. 3.
Figure 5:
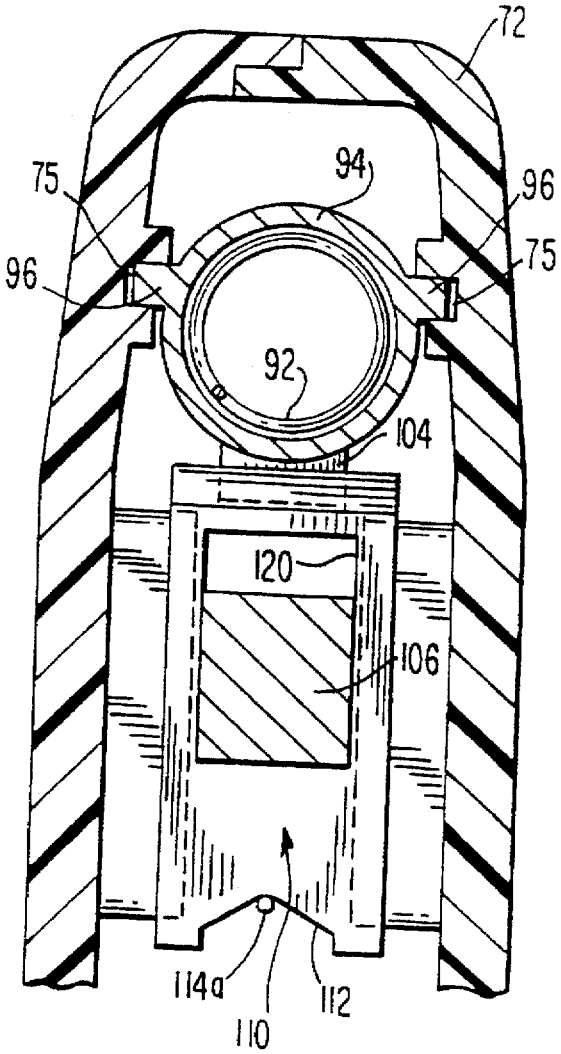
FIG. 5 is a sectional view taken along line 5—5 of FIG. 3.

Reference is now also made to FIGS. 4 and 5. In the preferred embodiment, plunger 77 has an essentially square cross-section. Plunger 77 includes an integrally formed elongated member 106 also having an essentially square cross-sectional area slightly less than the cross-sectional area of plunger 77, thereby defining edges 117 on the two lateral sides of plunger 77. Plunger 77 also includes a rib 75 integral therewith, which is slidably supported between respective inner walls 69 within housing 72 to permit plunger 77 to be slidable between the firing ready position and the ear piercing position. A ramp 108 (FIG. 3), integral with plunger 77 and elongated member 106, includes a sloped surface 108*a*. A plurality of inner walls 123, integrally molded within housing 72, slidably contain elongated member 106 in a horizontal direction and also maintain the integrity of the slide path of plunger 77 during the ear piercing procedure. Elongated member 106 also includes a plurality of integrally formed pegs 128. A torsion spring 130 is mounted within housing 72 on a post 116, integrally molded within housing 72. A first end 130*a* of spring 130 is captured by pegs 128 and biases plunger 77 in a direction away from push rod assembly 80. The second end 130*b* of spring 130 may be biased against a post 116*a*, formed integrally within housing 72.

A sear, generally indicated at 110, includes a frame 120 defining an opening dimensioned to receive elongated member 106. A plurality of inner walls 126, also formed integrally with an inner surface of housing 72, also assist in maintaining the sliding path of sear 110 in a vertical direction as illustrated by arrows E, F in FIG. 14. A notch 112 (FIG. 5) is formed in the bottom surface of sear 110 to receive biasing means, such as one end 114*a* of a second torsion spring 114. Spring 114 may also be positioned on post 116. A stop wall, plate or post 116*a*, may also serve to bias second end 114*b* of spring 114. Spring 114 biases sear 110 towards triangular ramp 104. A top surface 118 of sear 110 is correspondingly sloped to the slope of triangular ramp 104.

Spring gun assembly 70 may also include a stud cartridge receiving chamber 35 ("chamber 35") which is defined by a pair of integrally molded opposing walls 36 on housing 72. Opposing walls 36 are dimensioned to receive stud cartridge assembly 20 therein. Inner walls of each opposing wall 36 define a slot 38 for receiving annular shoulder 24 of stud cartridge 20 therein and to guide stud cartridge 20 during rotation. A plurality of U-shaped guides 37 integrally molded with opposing walls 36 are dimensioned to receive and support stud cartridge 20 when stud cartridge 20 is positioned within chamber 35 and positioned so that opposed flat sliding surfaces 26 and finger handle 32 are oriented parallel to opposing walls 36.

Once stud cartridge 20 is received in chamber 35, stud cartridge 20 rotates within U-shaped guides 37 and opposing slots 38 to move between a first piercing position and a second piercing position as illustrated in FIG. 11 by arrows G and H, respectively. Guides 37 include sloped tips 42 to guide stud cartridge 20 into place within chamber 35. Stud cartridge 20 remains secure within chamber 35 by the interference fit between guides 37 against the top and bottom surfaces 25 of stud cartridge 20 when stud cartridge 20 is rotated between the first and second positions.

A slit 39 is formed in walls 36 as an extension of slot 38 for receiving finger lever 32. Inner walls 40*a* and 40*b* defining slit 39 are also slightly tapered in a downward direction (FIG. 1), causing a slight biasing of finger lever 32 against opposing inner wall 40*a* of each respective slit 39. Accordingly, when finger lever 32 is rotated as described above, rib 34 of finger lever 32 is releasably received in a latch 39*a* formed in each opposing inner wall 40*a* (FIGS. 1, 12). In this way, stud cartridge 20 is retained in proper alignment throughout the piercing procedure.

Finger lever 32 is positioned relative to each bore 28 so that when finger lever 32 is positioned in a first position with slit 39, notch 33 contacts wall 36, as shown in solid lines in FIG. 11, bore 28 is coaxial with push rod 93. Rotation of finger lever 32 to a second position, in which second notch 33 contacts wall 36, shown in phantom in FIG. 11 aligning second bore 28 coaxially with push rod 93. Each stud 31 can then be ejected from stud cartridge 20.

As stated above, sear 110 is biased towards push rod assembly 80 by the biasing action of spring 114 against notch 112 of sear 110 (arrow E, FIG. 14). Moving cocking lever 95 in the direction of arrow G (FIG. 3) against the biasing action of spring 97 causes the sloped surface 118 of sear 110 to slidably engage sloped surface 104*a* of triangular ramp 104 pushing sear 110 away from ramp 104 allowing ramp 104 to slide over sear 110. Moving cocking lever 95 sufficiently in the direction of arrow G causes ramp 104 to completely pass over sear 110, disengaging from sear 110, so that sear 110 is biased in a direction against the underside of spring chamber 94 and against edge surface 104*b* of ramp 104, thereby releasably securing push rod assembly 80 in a firing ready position to pierce an ear (FIG. 3).

As described above, anvil 82 may be integrally formed with or affixed to plunger 77. Therefore, pulling trigger 79 in the direction indicated by arrow H (FIG. 14) against the biasing action of spring 130 draws anvil 82 towards push rod 93 during firing and helps ensure the close proximity of each clutch 60 and respective stud 31 to the earlobe being pierced. With push rod assembly 80 in a firing ready position (FIG. 3), pulling trigger 79 towards sear 110 causes the sloped surface of ramp 108 to engage a bottom edge of frame 120 of sear 110. As trigger 79 is pulled further, the sloped surface of finger 108 slidably engages sear 110 causing sear 110 to correspondingly move downward in the direction of arrow F (FIG. 14). Pulling trigger 79 still further causes finger 108 to engage the edge of frame 120 of sear 110 to move still further downward until sear 110 moves out of engagement with edge surface **104*b* of triangular ramp 104. With sear 110 out of engagement with triangular ramp 104, push rod assembly 80 is no longer secured into position and fires in direction D (FIG. 14) due to the biasing of spring 97 thereby causing push rod 93 to move towards anvil 82. Edges 117 on plunger 77 contact the front surface of sear 110 to prevent any further and unnecessary squeezing of trigger 79 and ensures that trigger 79 is pulled only enough to lightly squeeze the earlobe and secure the earlobe in place prior to piercing the ear, thereby preventing an unnecessary forceful contact between cartridges 20 and 50 with the earlobe. When trigger 79 is released, spring 130 biases member 106 causing plunger 77 to return to its prefiring position (FIG. 3). Biasing spring 114 moves sear 110 upward towards push rod assembly 80**.

In operation, a new sterile stud cartridge 20 is removed from its container (not shown) and aligned so that finger lever 32, and opposed flat sliding side surfaces 26, are parallel to opposed walls 36. Similarly, annular shoulder 24 is aligned with opposed slots 38 and slits 39 in opposed walls 36. Cartridge 20 is then slid downward into stud cartridge receiving chamber 35. To ensure that cartridge 20 cannot inadvertently fall out of receiving chamber 35, finger lever 32 is rotated until rib 34 engages latch **39*a* in either opposed wall 40*a*. U-shaped guides 37 also support curve surfaces 25 of casing 22**.

Similarly, a new, sterile clutch cartridge 50 is also removed from a container (not shown) and is oriented so that clutch handle 57 and legs 58 are aligned parallely to slot 84 for receipt of legs 58 therein. Clutch cartridge 50 is moved downward (arrow A, FIG. 10) towards annular track 88 and shoulder 86 on the front surface of anvil 82 until back wall 54 of clutch cartridge 50 is received flush against shoulder 86. Clutch handle 57 is rotated clockwise or counterclockwise (FIG. 9) causing each foot 59 to engage annular track 88 thereby rotatably releasably locking clutch cartridge 50 in place on anvil 82. To ensure proper alignment of clutch 60, clutch cartridge 50 is to be rotated, as shown in FIG. 6, until handle 57 engages an edge **86*a* or 86*b*, respectively, of annular shoulder 86. Handle 57 is positioned relative to clutches 60 so that rotation of handle 57 into contact with shoulder 86 in either direction causes a respective opening 65 to be substantially coaxial with push rod 93. Edges 86*a*, 86*b* of shoulder 86 against handle 57 prevents any further rotation of clutch cartridge 50 and ensure the coaxial alignment of push rod 93 and clutch 60**.

To ensure the proper alignment of push rod 93, stud 31 and clutch 60 during firing, stud cartridge 20 should be rotated until rib 34 engages latch **39*a* in inner wall 40*a* of either wall 36. Likewise, handle 57 of clutch cartridge 50 should be rotated until handle 57 engages an edge 86*a* or 86*b* of shoulder 86. The distance between each clutch 60 and annular shoulder 86 when handle 57 is rotated in a first direction is identical to the distance between shoulder 86 and the opposing clutch 60 when handle 57 has been rotated in the opposite direction. Similarly, push rod 93 and stud 31 are properly aligned for firing if rib 34 engages latch 39*a* in either inner wall 40*a*. Accordingly, one of the advantages of the present invention is that clutch cartridge 50 and stud cartridge 20 need not be rotated in the same direction for proper alignment. As long as each stud and clutch cartridge has been fully rotated as discussed above, push rod 93, stud 31 and clutch 60** will be coaxially aligned.

The place on the earlobe to be pierced is marked with a sterile pen or the like to indicate the appropriate piercing position. In an exemplary embodiment, casing 22 of stud cartridge 20 includes aiming groove 16 (FIG. 2) which permits the operator to see the tip of each piercing pin **31*b* in each bore 28. However, aiming groove 16, while sufficiently small enough to permit the operator to see the tip of stud 31, is sized to prevent the touching thereof. The tip of piercing pin 31*b* may be aligned with the mark on the earlobe. After alignment, the operator pulls trigger 79 causing push rod 93 to pass through bore 28 of cartridge 20, forcing stud 31 through stud cartridge 20** and the earlobe.

Piercing pin **31*b* has a diameter greater than the distance between ends 63 of each clutch 60. As piercing pin 31*b* passes through opening 65, piercing pin 31*b* passes between ends 63 of each clutch 60, spreading ends 63 farther from each other causing clutch 60 to secure stud 31. After firing spring gun 70, anvil 82 returns to its prefiring position by releasing the finger pressure from trigger 79 and the biasing of spring 130 against plunger 77 and the releasing of clutch 60 from clutch cartridge 50, which is attached to the earlobe by stud 31**.

After the first ear piercing procedure which causes the first stud 31 to be driven through the earlobe and affixed to clutch 60, cocking lever 95 should be returned to the firing ready position to permit push rod 93 to be removed from within bore 28. As discussed above, to place cocking lever 95 in the firing ready position, cocking lever is moved laterally in the direction of arrow G (FIG. 3) until sear 110 catches surface **104*b* of ramp 104. Thereafter, clutch cartridge 50 and stud cartridge 20 are rotated about 180° in a direction opposite to the direction each cartridge was originally rotated to align push rod 93 with the second and remaining clutch 60 and the second and remaining stud 31. Again, to ensure proper alignment of push rod 93, clutch 60 and stud 31, rib 34 of stud cartridge handle 32 should engage latch 39*a* of either inner wall 40*a* of side wall 36. Similarly, clutch cartridge 50 should be rotated so that handle 57 engages the opposing edge 86*a* or 86*b* of shoulder 86**.

Once again, the pulling of trigger 79 as disclosed above will cause the release of push rod 93 towards head **31*a* of the remaining stud 31 to complete the second piercing procedure which is similar in all respects to the piercing procedure described above with respect to the first stud 31 and first cartridge 60**.

As discussed above, tab 27 will break off as stud 31 is ejected through bore 28. This further maintains the sterility of the ear piercing assembly by eliminating the ability to undesirably reinsert another stud for piercing. Without tab 27 in place, stud 31 cannot be desirably maintained within bore 28. It is also contemplated that tabs 27 are merely deflected to provide clearance for stud 31 without shearing.

Accordingly, by providing an ear piercing assembly that includes a rotatable stud cartridge, a higher level of sterility of the studs during an ear piercing procedure by reducing the likelihood of human contact with the studs is achieved. Moreover, by providing an ear piercing assembly that includes a rotatable clutch cartridge, a higher level of sterility of the clutches during the ear piercing procedure is also achieved. By providing a rotatable ear piercing device, such as a spring gun that can receive a rotatable stud and/or clutch cartridge, an assembly that minimizes the handling of the stud and clutch cartridges during the ear piercing procedure is achieved. Still further, a rotatable ear piercing cartridge assembly still further advances the prior art assemblies by providing a stud and a clutch which are easily and accurately aligned prior to the piercing of the earlobe. By providing the cartridges with shearable retaining structures, reuse of the product is discouraged making each cartridge disposable.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ear piercing gun for piercing an ear, said gun comprising;

a housing;

a stud cartridge receiving chamber coupled to said housing and adapted to receive a stud cartridge therein, said stud cartridge adapted to releasably secure therein at least a first stud, said receiving chamber permitting said stud cartridge to rotate between a first position and a second position relative to said receiving chamber while being disposed therein; and a push rod slidably contained in said housing so that when said stud cartridge is disposed at said first position, a stud is coaxially aligned with said push rod.

2. The ear piercing gun as claimed in claim 1, wherein said stud receiving chamber is adapted to permit said stud cartridge to rotate to said second position so that when said stud cartridge is rotated to said second position, a second stud is coaxially aligned with said push rod.

3. The ear piercing gun as claimed in claim 1, and including a clutch positioner coupled to said housing and adapted to receive a clutch cartridge, said clutch cartridge adapted to releasably secure therein at least one clutch, said clutch positioner constructed to permit said clutch cartridge to rotate between a first position and a second position so that when said clutch cartridge is disposed at said first position, a first clutch is coaxially aligned with said push rod.

4. The ear piercing gun as claimed in claim 3, wherein said clutch positioner is adapted to permit said clutch cartridge to rotate to said second position so that when said clutch cartridge is rotated to said second position, a second clutch is coaxially aligned with said push rod.

5. An car piercing gun for piercing an car, said gun comprising;

a housing;

a stud cartridge receiving chamber coupled to said housing mad adapted to receive a stud cartridge therein, said stud cartridge adapted to releasably secure therein at least a first stud, said receiving chamber permitting said stud cartridge to rotate between a first position and a second position relative to said receiving chamber while being disposed therein;

a clutch positioner coupled to said housing and adapted to receive a clutch cartridge, said clutch cartridge adapted to releasably secure therein at least one clutch, said clutch positioner constructed to permit said clutch cartridge to rotate between a first position and a second position; and a push rod slidably contained in said housing so that when said stud cartridge is disposed at said first position and said clutch cartridge is disposed at said first position, a first clutch and a first stud being coaxially aligned with said push rod.

6. The ear piercing gun as claimed in claim 5, wherein said stud receiving chamber is adapted to permit said stud cartridge to rotate to said second position and said clutch positioner is adapted to permit said clutch cartridge to rotate to said second position so that when said stud cartridge is rotated to said second position and said clutch cartridge is rotated to said second position, a second clutch and a second stud are coaxially aligned with said push rod.

7. The ear piercing gun as claimed in claim 5, wherein said stud cartridge receiving chamber includes at least one wall, said stud cartridge receiving chamber adapted to receive said stud cartridge when said stud cartridge is aligned in a first position, said at least one wall being formed to secure said stud cartridge within said stud cartridge receiving chamber when said push rod and a first stud are coaxially aligned.

8. The ear piercing gun as claimed in claim 7, wherein said stud cartridge receiving chamber includes means to prevent the overrotation of said stud cartridge when said stud cartridge is rotated between said first and second positions.

9. The ear piercing gun as claimed in claim 8, and wherein said stud cartridge receiving chamber includes two opposing walls, said stud cartridge receiving chamber including a slot formed therein and dimensioned to receive said stud cartridge, each of said opposing walls including a slit dimensioned to receive said stud cartridge and assist in maintaining the alignment of said stud cartridge when said stud cartridge is in one of said first and second positions.

10. The ear piercing gun as claimed in claim 5, wherein said clutch positioner is constructed to receive said clutch cartridge when said clutch cartridge is aligned in a first position, said clutch positioner including means to secure said clutch cartridge within said clutch positioner when said push rod and a first clutch are coaxially aligned.

11. The ear piercing gun as claimed in claim 10, wherein said clutch positioner includes a retaining shoulder to position said clutch cartridge and facilitates coaxial alignment between a first clutch and said push rod when said clutch cartridge is rotated.

12. The ear piercing gun as claimed in claim 5, and including a push rod assembly and wherein said housing includes an aperture, said push rod assembly including a lever extending through said aperture, said push rod assembly being slidable within said housing between at least a first position and a second position, said aperture being dimensioned to receive therein means for releasably securing said push rod assembly in said first position.

13. An ear piercing assembly for piercing an ear, said assembly comprising:

a stud cartridge and at least a first stud adapted to be releasably secured therein;

a clutch cartridge and at least a first clutch adapted to be releasably secured therein;

an ear piercing gun including a housing and a stud cartridge receiving chamber adapted to releasably secure said stud cartridge therein and permit said stud cartridge to rotate between a first and a second position relative to said receiving chamber while being disposed therein, said ear piercing gun further including a clutch positioner adapted to releasably secure said clutch cartridge therein and permit said clutch cartridge to rotate between a first and second position relative to said clutch positioner while being disposed therein, a push rod slidably contained in said housing so that when said stud cartridge is in said first position and said clutch cartridge is in said first position, said first stud and said first clutch are coaxially aligned with said push rod.

14. The assembly as claimed in claim 13, wherein said stud cartridge includes a second stud releasably secured therein and said clutch cartridge includes a second clutch releasably secured therein, said receiving chamber being adapted to permit said stud cartridge to rotate to said second position and said clutch positioner being adapted to permit said clutch cartridge to rotate to said second position so that when said stud cartridge is rotated to said second position and said clutch cartridge is rotated to said second position, said second stud and said second clutch are coaxially aligned with said push rod.

15. The assembly as claimed in claim 13, wherein said stud cartridge is shaped to be rotatably secured in said stud cartridge receiving chamber when said first stud is coaxially aligned with said push rod.

16. The assembly as claimed in claim 15, wherein said stud cartridge is further shaped to be releasably removed from said stud cartridge receiving chamber when said first stud is not coaxially aligned with said push rod.

17. The assembly as claimed in claim 13, wherein said clutch positioner includes means defining a slot therebetween, said clutch cartridge being constructed to be rotatably secured in said clutch positioner when said clutch cartridge is rotated between said first and second positions, said clutch cartridge being further constructed to be releasably removed from said clutch positioner when said clutch is not coaxially aligned with said push rod.

18. The assembly as claimed in claim 17, wherein said clutch positioner includes a retaining shoulder to facilitate coaxial alignment between said at least first clutch and said push rod when said clutch cartridge is in said first position.

19. The assembly as claimed in claim 13, wherein said stud cartridge receiving chamber is adapted to receive said stud cartridge when said stud cartridge is aligned in a first position, said stud cartridge receiving chamber being constructed to secure said stud cartridge within said stud cartridge receiving chamber when said push rod and said at least first stud are coaxially aligned.

20. The assembly as claimed in claim 19, wherein said stud cartridge receiving chamber includes means to prevent the overrotation of said stud cartridge when said stud cartridge is rotated between said first and second positions.

21. The ear piercing gun as claimed in claim 13, and wherein said stud cartridge receiving chamber includes two opposing walls, said stud cartridge receiving chamber including a slot formed therein and dimensioned to receive said stud cartridge, each of said opposing walls including a slit dimensioned to receive said stud cartridge and assist in maintaining the alignment of said stud cartridge when said stud cartridge is in one of said first and second positions.

22. The assembly as claimed in claim 21, wherein said stud cartridge includes a retaining shoulder dimensioned to be received in said slot, said stud cartridge further including means to releasably secure said stud cartridge in said receiving chamber when said at least first stud and said push rod are coaxially aligned.

23. The assembly as claimed in claim 13, wherein said stud cartridge includes a first bore dimensioned to receive said at least first stud and a second bore dimensioned to receive a second stud, said stud cartridge further including means to releasably secure said first and second studs in said first and second bores, respectively.

24. The assembly as claimed in claim 23, wherein said means includes a tab integrally molded with said stud cartridge and disposed within a piercing path of said stud.

25. The assembly as claimed in claim 24, wherein said tab is detached from said stud cartridge by the force of said first and second stud contacting said tab as said first and second stud travel down its respective piercing path in said first and second bore, respectively.

26. The assembly as claimed in claim 23, wherein said first stud includes a head and a pin, said means including a first finger biased against said head for securing said first stud within said first bore and wherein said second stud includes a head and a pin, said means further including a second finger biased against said head of said second stud for securing said second stud within said second bore.

27. The assembly as claimed in claim 23, further comprising aiming means formed in said stud cartridge for aiming one of said first and second stud at an ear.

28. The assembly as claimed in claim 27, wherein said aiming means includes a first groove formed in said stud cartridge and a second groove formed in said stud cartridge, each groove being dimensioned to allow the viewing of said first and second stud in said first and second bore, respectively, but hinders the touching thereof.

29. A stud cartridge to be used with an ear piercing gun having a push rod for piercing an ear, said stud cartridge comprising:

a casing having at least one bore dimensioned to releasably secure a first stud therein; said casing being dimensioned to permit said stud cartridge to be releasably removed from said gun when said first stud is not coaxially aligned with said push rod of said ear piercing gun and further dimensioned to be releasably secured in said ear piercing gun when said stud cartridge is rotated to coaxially align said push rod and said first stud, said casing further dimensioned to rotate relative to said gun while disposed in said ear piercing gun.

30. The stud cartridge as claimed in claim 29, and including a pair of opposing flat walls formed integrally with said casing, said flat walls dimensioned to permit said stud cartridge to be releasably removed from said gun when said first stud and said push rod are not coaxially aligned.

31. The stud cartridge as claimed in claim 30, and including a pair of curved walls formed integrally with said casing, said curved walls shaped to permit said stud cartridge to be releasably secured within said gun when said stud cartridge is rotated to coaxially align said first stud and said push rod.

32. The stud cartridge as claimed in claim 29, and a retaining shoulder on said casing to facilitate alignment of said stud cartridge in said gun and facilitate the coaxial alignment of said first stud and said push rod.

33. The stud cartridge as claimed in claim 29, and including a second bore dimensioned to releasably secure a second stud therein, said stud cartridge constructed to rotate to a second position where said second stud and said push rod are coaxially aligned.

34. The stud cartridge as claimed in claim 33, and including first means formed integrally with said casing in said first bore and second means formed integrally with said casing in said second bore, said first means and said second means constructed to releasably secure said first and second studs in said first and second bores, respectively; said first means breaking off said casing after said stud has passed through said first bore and said second means breaking off said casing after said second stud has passed through said second bore.

35. The assembly as claimed in claim 33, wherein said first stud includes a head and a pin and wherein said second stud includes a head and a pin, a first finger molded with said casing and biased against said head for securing said first stud within said first bore and a second finger biased against said head of said second stud for securing said second stud within said second bore.

36. A clutch cartridge to be used with an ear piercing gun having a clutch cartridge receiving assembly for receiving said clutch cartridge and a push rod for piercing an ear, said clutch cartridge comprising:

a clutch housing having at least one clutch compartment releasably securing a first clutch therein;

means for permitting the releasable removal of said clutch cartridge from said clutch cartridge receiving assembly when said first clutch and said push rod are not coaxially aligned and for allowing said clutch cartridge to be releasably secured to said clutch cartridge receiving assembly when said clutch cartridge is rotated to a position where said first clutch and said push rod are coaxially aligned, said clutch housing adapted to rotate relative to said clutch cartridge receiving assembly while disposed in said clutch cartridge receiving assembly.

37. The clutch cartridge as claimed in claim 36, wherein said clutch housing includes a second clutch compartment for releasably securing a second clutch therein, said means further permitting said clutch cartridge to remain releasably secured in said clutch cartridge receiving assembly when said clutch cartridge is rotated so as to coaxially align said second clutch and said push rod.

38. The clutch cartridge as claimed in claim 37, wherein said means includes a plurality of biased legs integrally formed with said clutch housing and dimensioned to be received within, and be rotatable with respect to, an annular track formed on said clutch cartridge receiving assembly.

39. An ear piercing gun for piercing an ear, said gun comprising;

a housing;

a clutch positioner coupled to said housing and adapted to receive a clutch cartridge, said clutch cartridge adapted to releasably secure therein at least one clutch, said clutch positioner constructed to permit said clutch cartridge to rotate between a first position and a second position relative to said receiving chamber while being disposed therein; and a push rod slidably contained in said housing so that when said clutch cartridge is disposed at said first position, a first clutch is coaxially aligned with said push rod.

40. The ear piercing gun as claimed in claim 39, wherein said clutch positioner is adapted to permit said clutch cartridge to rotate to said second position so that when said clutch cartridge is rotated to said second position, a second clutch is coaxially aligned with said push rod.

* * * * *